US005971646A

United States Patent [19]

Chavatte et al.

[11] Patent Number: 5,971,646

[45] Date of Patent: Oct. 26, 1999

[54] WRITING IMPLEMENT USING LIQUID INK, IN PARTICULAR A SOLVENT-BASED INK

[75] Inventors: Philippe Chavatte, Wimereux; José Duez, Boulogne S/Mer, both of France

[73] Assignee: Conte S.A., Boulogne S/Mer, France

[21] Appl. No.: 08/986,277

[22] Filed: Dec. 5, 1997

Related U.S. Application Data

[63] Continuation of application No. 08/438,243, May 9, 1995, abandoned.

[30] Foreign Application Priority Data

May 11, 1994 [FR] France ..... 94 06026

[51] Int. Cl.[6] ..... B43K 8/04; B43K 8/06

[52] U.S. Cl. ..... 401/199; 401/198

[58] Field of Search ..... 401/198, 199

[56] References Cited

U.S. PATENT DOCUMENTS

| | | | |
|---|---|---|---|
| 3,501,225 | 3/1970 | Martin et al. | 401/198 |
| 4,256,494 | 3/1981 | Yamamoto et al. | 106/22 |
| 4,578,117 | 3/1986 | Nakanishi | 106/20 |
| 4,740,549 | 4/1988 | Okuzono et al. | 524/379 |
| 5,290,116 | 3/1994 | Chang | 401/199 |
| 5,318,617 | 6/1994 | Nagasawa et al. | 106/19 A |

FOREIGN PATENT DOCUMENTS

| | | | |
|---|---|---|---|
| 2205280 | 12/1988 | United Kingdom | 401/199 |

*Primary Examiner*—Steven A. Bratlie
*Attorney, Agent, or Firm*—Wolf, Greenfield & Sacks, P.C.

[57] ABSTRACT

A liquid ink writing implement comprises a body whose rear portion constitutes a reservoir for containing an ink, a transfer rod whose rear end opens out into the reservoir and whose front end projects out from the body and forms a writing tip, and a buffer reservoir in contact with the transfer rod. The ink has a surface tension lying in the range 21 of mN/m to 25 mN/m, and is intended for use on a non-absorbent media made of metal or of plastic. The surface tension of the material constituting the buffer reservoir is less than that of the ink by a predetermined difference which is preferably equal to or less than 4 mN/m, thereby enabling the buffer reservoir to absorb and give back any excess ink coming from the transfer rod by capillarity in the event of variation in the pressure inside the reservoir. The surface tension of the material of the buffer reservoir has been lowered by depositing an agent, whose surface tension is less than that of the ink but within the predetermined difference, e.g. fluorine, polysiloxane, or a fluorine-containing resin.

26 Claims, 2 Drawing Sheets

WRITING IMPLEMENT USING LIQUID INK, IN PARTICULAR A SOLVENT-BASED INK

This application is a continuation of U.S. Ser. No. 08/438,243 filed May 9, 1995 now abandoned.

FIELD OF THE INVENTION

The present invention relates to a writing implement using liquid ink, i.e. in which the ink is in the free state and is not held captive in a fiber reservoir. The implement includes a reservoir for the liquid ink, a rod operating by capillarity to transfer ink from the reservoir to a writing tip proper, said writing tip optionally being the free end of the transfer rod, and finally a buffer reservoir for absorbing and giving back excess ink in the event of the implement being used in conditions that are varying.

BACKGROUND OF THE INVENTION

In this type of writing implement, the reservoir containing the ink is not Isolated from ambient air, with air reaching the reservoir via the transfer rod. As a result, any variation in conditions of use, and in particular an increase in the pressure of the air contained in the reservoir due to said air heating, gives rise to an abnormal flow of ink along the transfer rod, which flow can give rise to smudges or blobs when the cap is taken off the implement. The function of the buffer reservoir is to absorb excess ink coming from the reservoir before it reaches the writing tip, i.e. the front end of the transfer rod which is used for writing purposes, and then, once normal conditions have been reestablished, of giving the ink it contains back to the transfer rod. Various embodiments of the buffer reservoir have already been proposed. In document EP 380 696, the buffer reservoir is a molded part having radial slots in the form of a comb and longitudinal slots putting said radial slots into communication with the hollowed-out central portion that is in contact with the transfer rod.

In document CH A 422 575, the buffer reservoir is a spongy mass of open cells, preferably made of a material that does not absorb the ink.

In document WO 92/20530, the structure of the buffer reservoir is defined merely as being a capillary storage element having capillarity that is, on average, less than the average capillarity of the transfer rod, at least at the junction orifice between the transfer rod and the tank of liquid ink.

The buffer reservoir is made of porous and/or fibrous material.

In document EP 516 538, the buffer reservoir is in the form of at least one compact block that fits snugly around the transfer rod. The buffer reservoir may include a porous hydrophobic material based on microspheres obtained by thermofusion of microspheres of one or more thermoplastic materials, and in particular microspheres of polypropylene or of polyethylene.

Writing implements using liquid ink and a buffer reservoir of the kind described above have given rise to applications only in the field of aqueous inks designed for writing on absorbent media.

SUMMARY OF THE INVENTION

The present invention is directed to a writing implement that is capable of being used with inks designed for writing on non-absorbent media, such as metals or plastics, e.g. on dry-erasable white boards. In such cases, the ink used is a solvent-based ink or an aqueous ink including a large quantity of wetting agent that enables the medium to be wetted.

Writing implements using buffer reservoirs having porous and/or fibrous materials typically allow the ink to diffuse into the buffer reservoir even when conditions of use are quite normal. When conditions of use suffer variation, the buffer reservoir can no longer act as such and the smudges or blobs which the buffer reservoir was supposed to avoid are therefore observed.

The object of the invention is therefore to propose a writing implement using liquid ink and a buffer reservoir that mitigates the above-specified drawback. More particularly, the invention provides a liquid ink writing implement comprising:

a) a body whose rear portion constitutes a reservoir for the ink;

b) a transfer rod whose rear end opens out into the reservoir and whose front end projects from said body and forms a writing tip; and c) a buffer reservoir in contact with the transfer rod.

In characteristic manner, the ink is an ink having surface tension lying in the range 21 mN/m to 25 mN/m, that is designed for use on non-absorbent media made of metal or of plastic, and the surface tension of the material included in the buffer reservoir is less than that of the ink, having a determined difference therefrom, the surface tension of the buffer reservoir being sufficient to enable it to absorb and to give back excess ink coming from the transfer rod by capillarity in the event of variation in the pressure inside the reservoir.

Analysis of the special conditions of capillarity in the buffer reservoir and of having determined the importance of the surface tension of the material of the buffer reservoir relative to the surface tension of the ink.

Preferably, the determined difference between the surface tension of the ink and that of the material including in the buffer reservoir is less than or equal to 4 mN/m.

Preferably, the buffer reservoir is made of a porous or a fibrous material, in particular polypropylene or polyester, whose surface tension has been lowered by depositing an agent having surface tension of less than 21 mN/m. The same effect of diffusion by capillarity with solvent-based inks or with aqueous inks having a large quantity of wetting agent can be achieved using buffer reservoirs of the kind previously described, but which have been subjected to treatment designed to achieve a surface deposit of an agent that modifies the initial surface tension of the buffer reservoir.

This treatment may include, in particular, in fluorination treatment, e.g. by means of a plasma. Under such circumstances, a surface layer of fluorine is put into place, thereby modifying the surface tension of the buffer reservoir, said surface tension then corresponding to that of fluorine.

In another version, the treatment may include polysiloxane deposition. When the buffer reservoir is based on fibers, this deposit can be obtained by impregnating the fibers in a bath of polysiloxane, by mangling, and by drying.

BRIEF DESCRIPTION OF THE DRAWINGS

The present invention will be better understood on reading the following description of a particular embodiment of a writing implement using liquid ink for a non-absorbent surface and including a buffer reservoir of porous polypropylene that has been fluorinated by means of a plasma, as shown in the accompanying drawings, in which.

DETAILED DESCRIPTION

The present invention relates to a writing implement using a liquid ink of the type in which the ink is contained in a reservoir and is transferred from said reservoir to a writing tip by means of capillarity along a transfer rod. The writing implement also includes a buffer reservoir in which, in the event of pressure variations in the tank, excess ink can migrate from the transfer rod and can then be returned when conditions of use return to normal.

Figure 1:
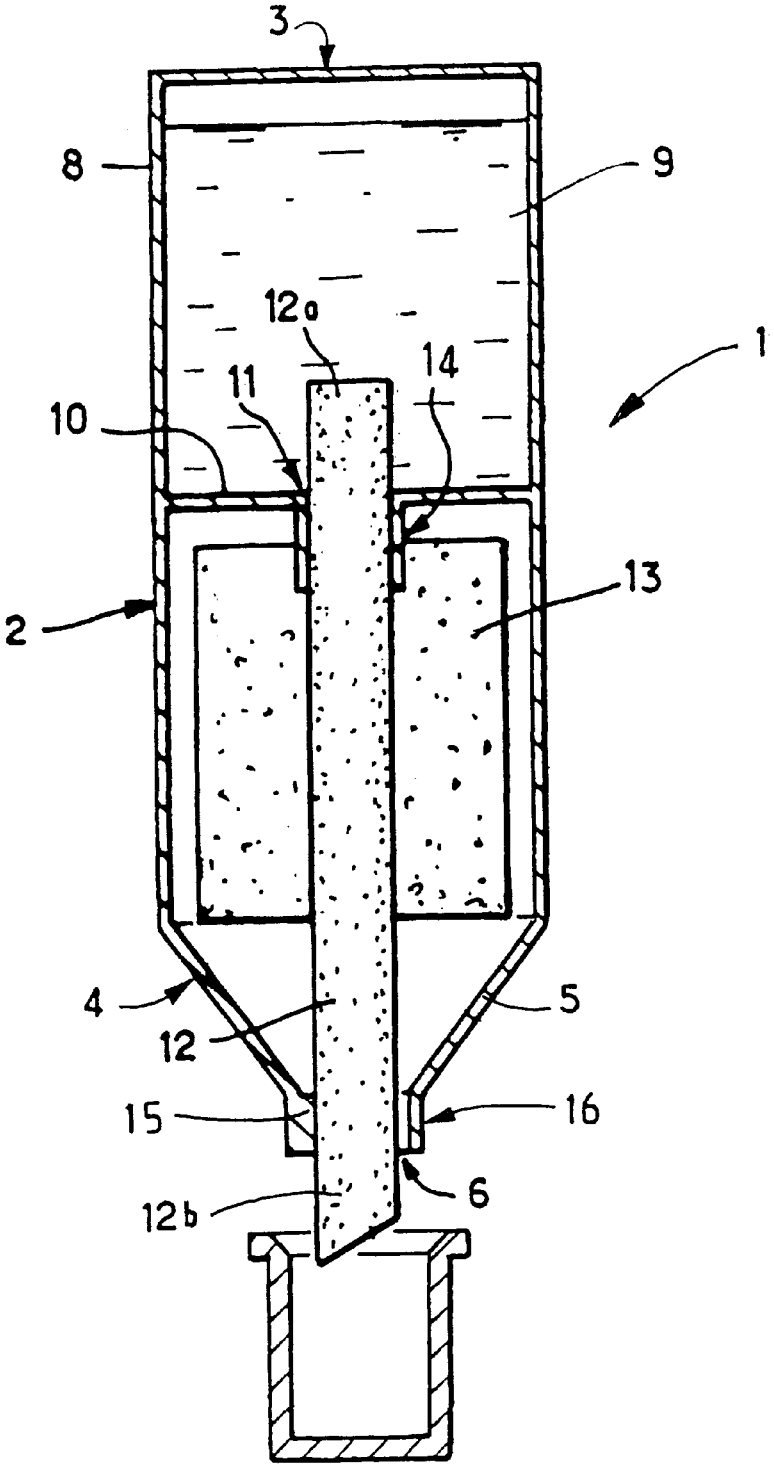
FIG. 1 is a diagrammatic longitudinal section through the implement.

FIG. 1 is a schematic illustration of a writing implement according the present invention.

The writing implement 1 is includes by a hollow body 2 that is substantially cylindrical and that has a closed rear end 3, and a front end 4 that is terminated in a cone 5 which includes a central orifice 6. The rear end of the body 7 may include a reservoir 8 for liquid ink 9. The reservoir 8 is closed by an internal partition 10 that has a central orifice 11.

The implement 1 includes a cylindrical transfer rod 12 made of a material suitable for transferring ink by capillarity. The implement one may included, in particular, a felt obtained from compacted polyester fibers or acrylic fibers. The rod 12 occupies the longitudinal axis of symmetry of the body 2. Its rear end 12*a* is received as a not very tight fit in the central orifice 11 of the partition 10, thereby ensuring that the reservoir 8 is leakproof, but without crushing the end 12*a* so as to ensure that air and ink can still flow therethrough via the rod 12.

As shown in FIG. 1, a tubular shoulder 14 is preferably provided on the internal partition 10 to surround the central orifice 11 through which the rod 12 passes. This tubular shoulder 14 serves to ensure good leakproofing of the reservoir 8 without crushing the end 12*a* of the rod 12.

The front end 12*b* of the rod 12 is pointed in a chamfer configuration, in a conical configuration, or in any other configuration; it forms a writing tip and it is centered in the central orifice 6 of the conical portion 5 of the body 2. This centering is preferably achieved by lugs 15 distributed around the inside periphery of the neck 16 that extends the cone 5; the lugs 15 define empty spaces around the leading end 12*b* of the rod, thereby allowing air to flow in to and out from the implement 1.

Finally, the implement 1 has a buffer reservoir 13 surrounding the transfer rod 12 inside that portion of the body 2 that lies between the reservoir 8 and the cone 5.

The function of the buffer reservoir 13 is both to absorb and to give back any excess ink coming from the transfer rod 12 in the event of variations in the conditions of use of the implement 1.

In normal operation, the ink 9 contained in the reservoir 8 and in contact with the rear end 12*a* of the rod 12 is absorbed and transferred by capillarity along the rod 12 to its front or leading end 12*b*. The ink consumed by the writing tip is replaced as fast as it is used by fresh ink coming from the reservoir 8. Pressure equilibrium is established between the air contained in the reservoir 8 and the air within the remainder of the body 2.

In abnormal operation, in particular in the event of an increase in the pressure inside the reservoir 8, e.g. when the implement 1 is heated, excess ink 9 flows out from the reservoir 8 into the rod 12.

In the absence of the buffer reservoir 13, this excess ink would travel all the way to the writing tip 12*b* and would cause the implement 1 to be fed with an abnormal amount of ink, thereby making it tend to form smudges or blobs on the writing medium. Because of the buffer reservoir 13, this excess ink does not reach the writing tip 12*b*; instead, the excess ink diffuses by capillarity into the buffer reservoir 13 which is in contact with the capillaries of the rod 12, and this continues until pressure equilibrium is reestablished. Thereafter, when the implement 1 is reused, the ink consumed by the writing tip 12*b* is drawn preferentially from the buffer reservoir 13.

In the embodiment described in document EP 516 538, the buffer reservoir 13 is in the form of a compact block that fits snugly around the rod 12, and it is made of an open-pored material of considerable porosity. The material may be fibrous, or alternatively the buffer reservoir could be constituted by a molded part having radial slots in the form of a comb together with longitudinal slots putting the radial slots into communication with a hollowed-out central portion that is in contact with the transfer rod, as taught in document EP 380 696.

The object of the present invention is to make such a writing implement 1 usable on non-absorbent media of the dry-erasable white board type or on media made of metal or of plastic. It is known that in such cases the ink used must be capable of wetting the medium sufficiently to obtain adequate marking. Under such circumstances, use is made of solvent-based inks or of aqueous inks that include wetting agents for altering their ability to wet such media.

In general the surface tension of the inks used for such media lies in the range 21 mN/m to 25 mN/m.

The writing implement 1 as described above has, until now, only been used with aqueous inks, i.e. for writing on absorbent media. The object of the present invention is to modify the writing implement 1 in such a manner as to enable it to be used on non-absorbent media or on media made of metal or of plastic.

In characteristic manner, firstly the ink 9 is an ink having surface tension lying in the range 21 mN/m to 25 mN/m, and secondly the buffer reservoir 13 has surface tension of a value that is smaller than that of the ink. The difference between the surface tension of the material including the buffer reservoir 13 and the surface tension of the ink 9 is such as to enable the buffer reservoir both to absorb and to give back excess ink coming by capillarity from the transfer rod 12 in the event of variations occurring in the pressure that exists in the reservoir.

It has been observed that when using a solvent-type ink, the hydrophobic buffer reservoir of polypropylene as described in document EP 516 538 filled with ink even during normal operating conditions.

To obtain a buffer reservoir that is versatile, i.e. that is capable of being used with any type of ink having surface tension lying in the range 21 mN/m to 25 mN/m, it is preferable for the specified difference between the surface tensions of the material included in the buffer reservoir and the ink to be less than or equal to 4 mN/m.

This can be achieved by making the reservoir out of a material that has such surface tension, or else by modifying the material from which the buffer reservoir is made so as to lower its surface tension by depositing thereon an agent that has a lower surface tension, e.g. a surface tension of less than 21 mN/m.

To obtain such a result, it is possible to treat an already available buffer reservoir 13, e.g. as obtained by thermofusion of a mixture of microspheres or microbeads of two different types of polypropylene of different grades, i.e. polypropylenes having different melting temperatures, as described in document EP 516 538, or by thermoadhesive of microspheres made of a single thermoplastic material. As mentioned above, when the reservoir is used with inks of the solvent type or including wetting agents, it fills with ink even when the implement is used under normal conditions of pressure and temperature.

However, if the buffer reservoir is subjected to fluorination treatment in a plasma medium, the buffer reservoir 13 performs its function, i.e. it absorbs ink 9 from the rod 12 only in the event of a pressure change within the reservoir 8. The effect of the fluorination treatment is to deposit a fine layer of fluorine on the surface of the polypropylene from which the buffer reservoir is made, thereby reducing its surface tension until it is less than 21 mN/m, for example.

It is possible to apply such plasma fluorination treatment to any type of material that is suitable for the buffer reservoir.

It is also possible to treat, not an already formed buffer reservoir, but the materials of buffer reservoir, prior to the reservoir being made therefrom. In particular, if the buffer reservoir is made of fibers, e.g. based on polypropylene or polyester fibers, it is possible to deposit a fine layer of polysiloxane or of a fluorine-containing resin on the surface of the fibers by impregnating the fibers in a bath containing one or other of the ingredients, followed by mangling and by drying.

The surface tension of the buffer reservoir 13 must be less than that of the ink 9 contained in the reservoir 8. However, it must not be too low insofar as that would prevent the ink 9 from migrating into the buffer reservoir 13 even in the event of variation in the pressure within the reservoir 8. The buffer reservoir 13 could then no longer perform the function it is intended to perform. According to the Applicant, the difference between the surface tension of the buffer reservoir and that of the ink should not exceed 4 mN/m.

The buffer reservoir 13 may have surface tension that varies within its own volume. In particular, such variation in surface tension may be achieved by making up the buffer reservoir 13 as a modular assembly in the longitudinal direction relative to the transfer rod 12. It is preferable for the surface tension of the buffer reservoir to be greater close to the reservoir 8 than close to the central outlet orifice of the transfer rod, so that any excess ink that might appear preferentially adjacent to the reservoir 8 is absorbed.

Figure 2A:
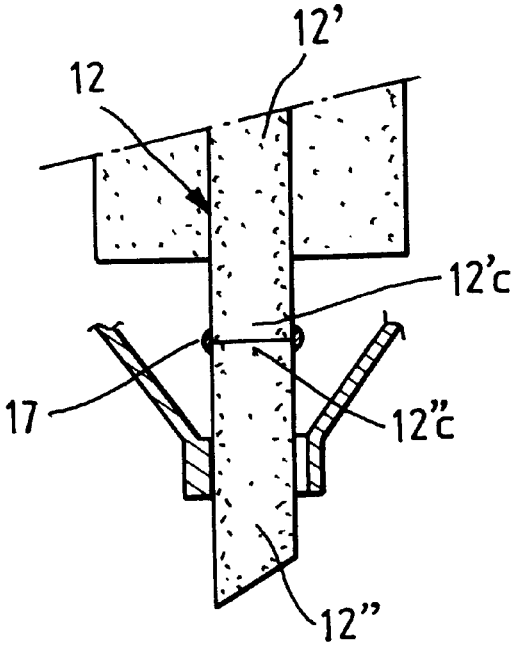
FIGS. 2A to 2C are fragmentary diagrammatic section views through the transfer rod.
Figure 2B:
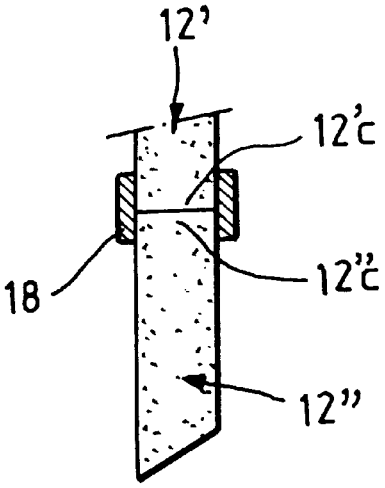
Figure 2C:
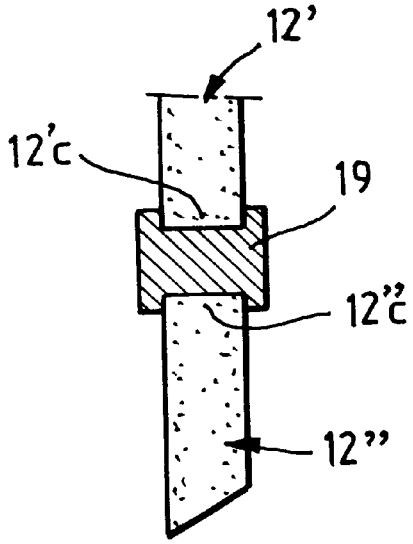

FIG. 2 shows various embodiments of the transfer rod 12 that can be implemented in order to facilitate manufacture and assembly. In all of these variants, the transfer rod 12 is made up of two portions that are connected to each other by connection means. The connection must enable the transfer rod to perform its function of diffusing ink 9 from the reservoir 8 to the writing tip, in spite of the rod being split into two portions 12' and 12" which may be of the same kind or of different kinds. The first portion 12' has its rear end 12'*a* penetrating into the reservoir 8, while the second portion 12" has its front end 12"*b* forming the writing tip and projecting out of the body 2. The buffer reservoir 13 is in contact with the first portion 12'.

The first portion 12' includes a capillary stick. The second portion includes a writing or marker tip of any kind, e.g. an extruded tip, a roller tip, a pen nib, a felt tip, or a polyester or acrylic fiber tip.

The connection between the front end 12'*c* of the first portion 12' and the rear end 12"*c* of the second portion 12" may be obtained, for example, by applying adhesive 17 (FIG. 2A), or by welding, or by means of a sheath 18 (FIG. 2B) which may optionally be welded in place, or else by means of a connection part 19 made of a hydrophilic fiber or of a capillary porous material that is hydrophilic.

The present invention is not limited to the preferred embodiment that has been described by way of non-exhaustive example. In particular, when using a buffer reservoir of the kind disclosed in document EP 380 696, it will be possible by means of an appropriate treatment, in particular plasma fluorination, to make the writing implement in which it is inserted suitable for use on non-absorbent media, and in particular dry-erasable white boards, or media made of metal or of plastic.

We claim:

1. A liquid ink writing implement comprising:

a) a body having a rear portion including a reservoir;

b) a transfer rod whose rear end opens out into the reservoir and whose front end projects out from said body and forms a writing tip;

c) a buffer reservoir in contact with the transfer rod; and d) an ink contained in the reservoir wherein the ink has a surface tension in the range of 21 mN/m to 25 mN/m, and is suitable for use on a non-absorbent media, and wherein the buffer reservoir is made of a material which has a surface tension less than that of the ink by a predetermined difference which is less than or equal to 4 mN/m.

2. A writing implement according to claim 1, wherein the surface tension of the material of the buffer reservoir is lowered by depositing thereon an agent whose surface tension is less than that of the ink and lies within the predetermined difference.

3. A writing implement according to claim 2, wherein the agent deposit is a deposit of fluorine.

4. A writing implement according to claim 3, wherein the fluorine deposit is obtained by plasma fluorination treatment.

5. A writing implement according to claim 2, wherein the agent deposit is a deposit of fluorine-containing resin.

6. A writing implement according to claim 5, wherein the material of the buffer reservoir is based on fibers, and wherein the deposit is obtained by impregnating the fibers in a bath of fluorine-containing resin, by mangling, and by drying, prior to forming the buffer reservoir.

7. A writing implement according to claim 2, wherein the agent deposit is a deposit of polysiloxane.

8. A writing implement according to claim 7, wherein the material of the buffer reservoir is based on fibers, and wherein the deposit is obtained by impregnating the fibers in a bath of polysiloxane, by mangling, and by drying, prior to forming the buffer reservoir.

9. A writing implement according to claim 1, wherein the surface tension of the material of the buffer reservoir varies in the longitudinal direction as determined by the direction of the transfer rod, being greater close to the reservoir than close to a central outlet orifice of the rod.

10. A writing implement according to claim 1, wherein the transfer rod is made up of two interconnected portions: a first portion whose rear end penetrates into the reservoir; and a second portion whose front end forms the writing tip and projects out from the body; wherein the buffer reservoir is in contact with said first portion; and wherein the implement includes means for connecting the front end of the first portion to the rear end of the second portion.

11. A writing implement, comprising:

an ink reservoir, a buffer reservoir, and a transfer rod fluidly connected to the ink reservoir and the buffer reservoir;

an ink having a surface tension in the range of 21 mN/m to 25 mN/m; and a buffer material positioned in the buffer reservoir having a surface tension of about 4 mN/m or less than the surface tension of the ink.

12. The writing implement of claim 11, wherein the surface tension of the buffer material increases in a longitudinal direction towards the ink reservoir.

13. The writing implement of claim 12, wherein the buffer material further comprises a surface deposit, the surface deposit having a surface tension of about 4 mN/m or less than the surface tension of the ink.

14. The writing implement of claim 13, wherein the surface deposit includes fluorine.

15. The writing implement of claim 13, wherein the surface deposit is a polysiloxane deposit.

16. The writing implement of claim 11, wherein the buffer material further comprises a surface deposit, the surface deposit having a surface tension that is about 4 mN/m or less than the surface tension of the ink.

17. The writing implement of claim 16, wherein the surface deposit includes fluorine.

18. The writing implement of claim 16, wherein the surface deposit is a polysiloxane deposit.

19. A buffer reservoir for a writing instrument containing an ink, comprising:

a buffer material having a surface tension of about 4 mN/m or less than a surface tension of the ink; and wherein the ink has a surface tension in the range of 21 mN/m to 25 mN/m.

20. The buffer reservoir of claim 19, wherein the surface tension of the buffer material increases in a longitudinal direction toward one end of the buffer reservoir.

21. The buffer reservoir of claim 20, wherein the buffer material further includes a surface deposit, the surface deposit having a surface tension of about 4 mN/m or less than the surface tension of the ink.

22. The buffer reservoir of claim 21, wherein the surface deposit includes fluorine.

23. The buffer reservoir of claim 21, wherein the surface deposit is a polysiloxane deposit.

24. The buffer reservoir of claim 19, wherein the buffer material further includes a surface deposit, the surface deposit having a surface tension that is about 4 mN/m or less than the tension of the ink.

25. The buffer reservoir of claim 24, wherein the surface deposit includes fluorine.

26. The buffer reservoir of claim 24, wherein the surface deposit is a polysiloxane deposit.

* * * * *